US006451409B1

(12) United States Patent
Lassiter

(10) Patent No.: US 6,451,409 B1
(45) **Date of Patent: *Sep. 17, 2002**

(54) ROOFING MATERIAL WITH INTEGRALLY FORMED NAIL TABS

(76) Inventor: Robert F. Lassiter, 141 S. Barton La., Levelland, TX (US) 79336

( * ) Notice: Subject to any disclaimer, the term of this patent is extended or adjusted under 35 U.S.C. 154(b) by 0 days.

This patent is subject to a terminal disclaimer.

(21) Appl. No.: 08/561,816

(22) Filed: Nov. 22, 1995

Related U.S. Application Data

(63) Continuation-in-part of application No. 08/544,300, filed on Oct. 17, 1995, now abandoned.

(51) Int. Cl.[7] ..... E04B 7/00

(52) U.S. Cl. ..... 428/147; 428/195; 428/198; 428/196; 428/197; 428/200; 428/206; 428/207; 52/408; 52/410; 52/411; 52/413; 52/376; 52/364; 52/366

(58) Field of Search ..... 428/147, 195, 428/198, 196, 197, 200, 206, 207; 52/408, 410, 411, 413, 376, 364, 366

(56) References Cited

U.S. PATENT DOCUMENTS

| | | | | |
|---|---|---|---|---|
| 3,779,373 A | | 12/1973 | Maier | 206/56 DF |
| 3,841,474 A | | 10/1974 | Maier | 206/346 |
| 3,904,032 A | | 9/1975 | Maier | 206/347 |
| 4,033,499 A | | 7/1977 | Butler | 227/120 |
| 4,554,196 A | * | 11/1985 | Meeker | 428/67 |
| 4,624,721 A | | 11/1986 | Sadler et al. | 156/92 |
| 4,627,207 A | | 12/1986 | Young et al. | 52/361 |
| 4,641,472 A | | 2/1987 | Young et al. | 52/361 |
| 4,788,807 A | | 12/1988 | Whitman | 52/410 |
| 5,130,178 A | * | 7/1992 | Zerfass et al. | 428/198 |
| 5,309,685 A | * | 5/1994 | Rathgeber et al. | 52/58 |
| 5,365,709 A | | 11/1994 | Lassiter | 52/408 |
| 5,407,313 A | | 4/1995 | Bruins et al. | 411/544 |
| 5,415,511 A | | 5/1995 | Damron | 411/480 |
| 5,469,671 A | * | 11/1995 | Rathgeber et al. | 52/58 |

* cited by examiner

*Primary Examiner*—William P. Watkins, III

(57) ABSTRACT

A composite roofing material includes a final condition underlayment material having bonded thereto appropriate rows of nail tabs preferably made of thermoplastic-based material, such as low density polyethylene material, and of a contrasting color to the underlayment material. A process is used to make the nail tabs by conveying the saturated underlayment material in a continuous process past appropriate sets of nozzles that are coordinated with the speed of conveyance to deposit the tabs while in a liquid state and to form tabs of appropriate size and appropriately patterned across the underlayment surface. Each nozzle can include multiple orifices to control the width and thickness of the formed tabs. A similar process is disclosed for making other building cover materials having rows of nail tabs coinciding with standard stud spacing.

8 Claims, 2 Drawing Sheets

ROOFING MATERIAL WITH INTEGRALLY FORMED NAIL TABS

This application is a continuation-in-part of application Ser. No. 08/544,300, filed Oct. 17, 1995, now abandoned, entitled "Roofing Material With Integrally Formed Nail Tabs" by the same inventor.

FIELD OF THE INVENTION

This invention pertains to roofing materials or other building materials normally employed as cover materials prior to the installation of roofing shingles or external building finish siding and more specifically to such cover materials incorporating therein a plurality of integrally formed nail tabs.

BACKGROUND OF THE INVENTION

A shingle roof installation generally comprises at least two distinctive layers. The first layer is an underlayment, usually a saturated asphalt material that attaches directly to the plywood sheets or board material that supports the shingles. The second layer is made up of the shingles themselves. Normally, the underlayment assists in making the roof resistant to water intrusion. The starting material for the underlayment is a base material usually referred to as "dry felt". Examples of types of dry felt starting material are rag, paper and fiberglass, which is not exhaustive of possible starting base materials. The starting base material that has actually been subject to experimentation is a fibrous paper made from treating recyclable cardboard; however, this invention is not limited thereto. The term "dry felt" used herein is used generically for all suitable starting base material. Dry felt material when saturated with an asphalt material produces an underlayment roofing material known in the trade as "tar paper" or "saturated felt", which is produced in various grades depending on thickness and weight.

Regardless of the type of underlayment roofing material that has been employed, common practice in the installation industry has been to unroll a length of the underlayment material and affix each length to the support sheets or boards at a plurality of locations so that it stays in place prior to the installation of the covering shingles. The affixing or fastening devices for this material are generally staples and nails. Staples and regular nails are readily applied by power devices; however, both are notoriously susceptible to either pulling out of the sheets or boards when there is an uplift on the underlayment or, when the staples or nails stay in place, tearing of the roofing material at the fastening locations. Even when shingling is to follow immediately, the underlayment can still be exposed alone to windy and other adverse conditions, such as when the installers walk or crawl on the underlayment.

Moreover, it is desirable that the underlayment be securely attached independently of the shingles not only in the pre-shingling stage of installation, but also in the final installation. This is because shingles do get blown or ripped off under adverse weather conditions and a securely independently installed underlayment will provide some interim protection from the weather elements prior to roof repair. When the underlayment is not securely fastened, then the underlayment may be blown away or ripped concurrently with shingle damage.

To securely install the underlayment and avoid the tearing described above, it has long been a common practice to either use roofing nails with large heads or to use an auxiliary large washer or tab that lies underneath the nail head. Such large washer or tab successfully resists being torn through as with a smaller nail head of regular size. The use of such washer or tab has not been totally satisfactory, however, since such use is time consuming, somewhat expensive, and can be somewhat dangerous when the installation is on a fairly steeply pitched roof and/or the conditions are inclement. This is because it requires two hands to either slip the washer over the nail or to hold a tab down while driving the nail through. If the installer is having to reach while only supporting himself or herself on a toeboard, it may be uncomfortable and/or unstable to be unable to use either hand for additional support when necessary. Moreover, nails with large, unconventional heads are not recommended both because they are expensive and because they cannot be used in ordinary power equipment. ordinarily, power equipment for driving nails can be loaded only with standard nail cartridges.

U.S. Pat. No. 5,365,709, commonly owned herewith, describes an improved underlayment roofing material that includes a plurality of suitable nail tabs attached to a felt base. The concept therein described was to produce a roll of underlayment that had the tabs in place so that the installer would not have to separately handle a washer or a separated tab and nail. With the tabs in place, the installer would merely target the tabs one by one with a conventional power driven nail gun. Such installation would be many times faster than installations previously described and would be less cumbersome to the installer since the nailing process would not require both hands when a nail gun is used. However, the underlayment therein described has not been used commercially. To make a dry felt material with glued-on tabs, as described in the '709 patent, into saturated felt material requires the adhesive and the tab material to not materially degrade during the asphalt saturation process. The high temperature of this process and the rollers used tend to either melt the adhesive glue, melt the tab material itself, scrape off the tabs, or a combination of all three, any of which renders the resulting saturated felt material unreliable, if not unsuited, for commercial use.

It has been discovered, as hereinafter described, that tabs can be permanently and reliably affixed or bonded to saturated felt material avoiding many of the problems attendant to affixing tabs to the dry felt base material as described in the '709 patent. Moreover, it has been discovered that the process of producing suitable tabs onto saturated felt material can be automated using liquid thermoplastic tab material that quickly solidifies and adheres or bonds to the surface of the saturated felt material.

Also, importantly, it has been discovered that the production of tabs onto the saturated felt material can be done immediately following the step of dipping or spraying the dry felt material with a suitable hot asphalt mix to make saturated felt material. Thus, the conversion of dry felt to saturated felt can be combined in an automated process with the subsequent production of the tabs.

In addition to saturated felt material used in a roofing application, suitable tabs can also be similarly installed using liquid thermoplastic tab material to other base sheeting materials, such as siding materials used for wrapping the side of a framed house or other structure prior to securing the finish siding.

Therefore, it is a feature of the present invention to provide an improved sheeting material having nail tabs produced directly onto at least one of its surfaces.

It is another feature of the present invention to provide an improved underlayment roofing material incorporating nail tabs therein that are tough and compliant that are produced directly on saturated felt material.

It is yet another feature of the present invention to provide such an underlayment roofing material incorporating nail tabs therein that are of a material that is reliable when used in the extremes of ambient temperature conditions encountered in typical installations.

It is still another feature of the present invention to provide an improved underlayment roofing material utilizing an automated process for applying a liquid thermoplastic material at appropriate tab positions using nozzles that are readily programmably controlled.

It is yet another feature of the present invention to provide an improved underlayment material, wherein the overall process is continuous and automated to include the saturation of dry felt material to make saturated felt material followed by the production of suitable nail tabs from pressurized liquid thermoplastic-based or other material that subsequently hardens and securely bonds to the surface of the saturated felt material.

SUMMARY OF THE INVENTION

A composite roofing material is made starting with a roll of dry felt material. In the preferred method of producing the underlayment roofing material in accordance with this invention, the dry felt material is introduced to the beginning of a continuous and automated process having a system of driven rollers for transporting the roofing material through the process. First, the dry felt material undergoes treatment in conventional fashion to produce asphalt saturated felt material from the dry felt material. Then, a suitable liquid thermoplastic-based or other material is deposited on the rapidly moving saturated felt using appropriately positioned nozzles or nozzle sets. The on/off operation of the nozzles or nozzle sets and the movement of the saturated felt material are respectively controlled and coordinated by one or more suitable programmable microprocessors. The thermoplastic-based material may include an appropriate adhesive to ensure that it bonds to the surface of the saturated felt material as it rapidly cools and hardens to form the desired nail pads or tabs. The thermoplastic-based material may be reinforced with fibers, flakes or other similar particles, and such material may also include a color contrasting dye to that of the underlying saturated felt material, which is normally black. Even without an added dye, however, the tabs do contrast in color and are readily visible.

By the time the saturated felt material with tabs reaches a "free looper" stage, the tabs are sufficiently cooled and hardened to operational conditions. That is, they are tough, but flexible. The free looper is followed by a final stage, where the underlayment material with tabs is wound to make up standard sized rolls. The free looper allows this action to occur without impacting on the prior continuous movement of the conveyed saturated felt during the foregoing tab producing stage of the operation.

As mentioned, the final resulting composite roofing material just described is manufactured using a machine that includes one or more depositing nozzles at each row location. The liquid thermoplastic-based or equivalent material is normally supplied to the depositing nozzles under pressure. The nozzles are turned on and then off to deposit the material in the correct quantity and at the correct spacing, which preferably staggers the tabs across the width of the base felt material. The line speed of conveyance determines, through the operation of a microprocessor, the durations of both the "on" time and the "off" time.

Each "nozzle" used for making the deposits is preferably either a plurality of closely spaced orifices in a common manifold housing or an elongated slit opening so as to cover a wide enough area for making tabs of the preferred width dimension without forming a tab that is too thick. When a plurality of orifices are employed, the liquid material flowing from the individual orifices blends together, cools and hardens to form the individual tabs.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

In the drawings.

DESCRIPTION OF THE PREFERRED EMBODIMENTS

The making of the composite roofing material preferably employs a machine manufactured by Nordson Corp. of Westlake, Ohio that uses one or more nozzle sets for dispensing multiple beads of viscous liquid, as set forth in U.S. Pat. No. 5,335,825, which is incorporated herein for all purposes. This machine has been utilized in the past, for example, in laying down small beads of glue onto stock cardboard, which when subsequently cut and folded produces boxes. Other suitable equipment can be used, if desired.

Figure 1:
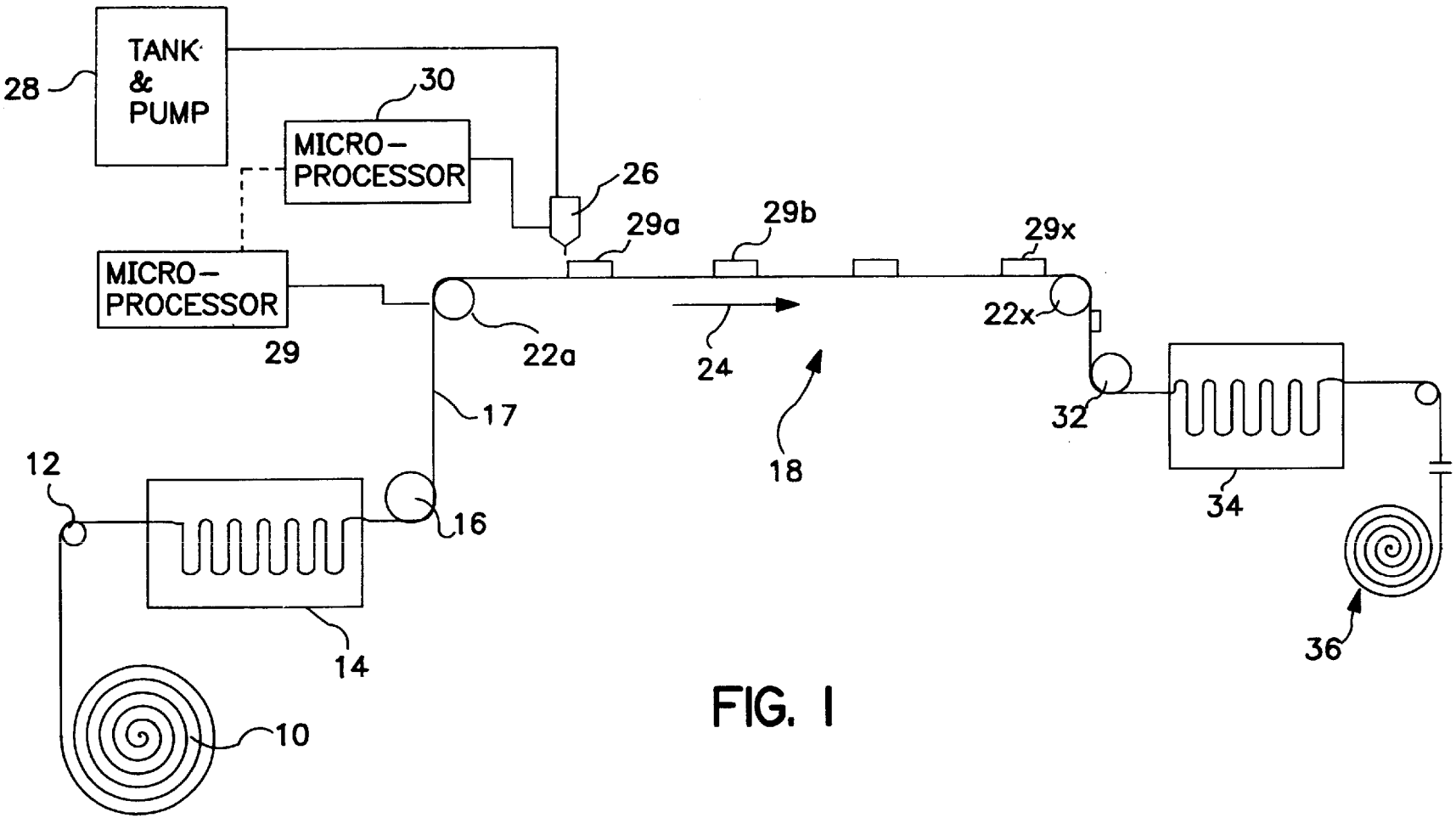
FIG. 1 is a schematic side view of an automated process of manufacturing a composite roofing material of the invention in accordance with a preferred procedure.

The process illustrated in FIG. 1 is generally a roller driven system that moves from left to right in the drawing. The end of a roll 10 of appropriate dry felt material to be saturated is conveyed using a drive roller 12 to a treatment area 14 for asphalt saturating the dry felt in conventional fashion. This saturating treatment stage is illustrated as a series of turns of the unrolled felt material since that fairly represents how the material is fed through the hot asphalt bath or pit to saturate the dry felt material. The temperature of the asphalt that is applied is typically in excess of 400° F. As the saturated felt material exits the saturating treatment stage, it may be cooled by use of a water cooled chill roll 16. Other means of cooling the saturated felt may be used, if desired. For example, conveying the material through a long distance in a cool ambient environment would produce the same cooling result.

It has been discovered, however, the subsequent production of the nail tabs can be produced without detriment onto the surface of the saturated felt material even though this felt material is at an elevated temperature near to the temperature condition that it leaves treatment area 14. Thus, there is no need for use of a rapid cool-down scheme for the saturated felt material. The only cool-down that is required is for the felt material to be sufficiently cooled at the end of the procedure to permit being wound into conventionally sized rolls, as hereafter described.

As the felt leaves treatment area 14, it is saturated felt material 17. Material 17 is driven in direction 24 through the nail tab production area 18 by a plurality of driven rollers 22*a*, . . . 22*x*. Although only two rollers are shown in the illustration for convenience, an actual system will have multiple rollers in area 18. They are driven by a motor and drive system (not shown) well known in the art at a speed that is selected by an operator. The line speed of felt material 17 in area 18 is closely monitored by microprocessor 29 connected to roller 22*a*.

The thermoplastic-based material to be dispensed onto the surface of the moving saturated felt material is dispensed from nozzles or nozzle sets 26 as provided from a pressurized supply tank and pump system 28. The typical thermoplastic-based material is also heated to a liquid state in system 28 or as it is introduced to system 28. A preferred example of a suitable thermoplastic-based material is a low density polyethylene compound EA839, a proprietary blend produced by Eastman Chemical Corp. Such a compound includes one or more suitable adhesives that enhance the bonding of the material to the surface of the saturated felt material. The compound may also include a suitable contrasting dye color, such as red, to make the tabs stand out against the normally black background color of the saturated felt. Without an added dye, the material is amber in color, which naturally contrasts somewhat in color to black. Other suitable thermoplastic-based materials can be selected such as ethylene vinylacetate, or if desired, a thermosetting-based material such as a two component polyurethane.

Color can also be provided independently of a dye put into the thermoplastic-based material. For example, it can be fed to the nozzle from an independent source to be combined with the thermoplastic material just before nozzle dispensing and as the application takes place.

Regardless of the nail tab material used, it must be either fast-cooling or fast-setting so that it bonds and solidifies to the surface of the saturated felt before it leaves line area 18. The tabs, as they are bonded to the material, are tough, but remain flexible or pliable and not brittle. Normal operating conditions for roof installations are from below ambient freezing conditions, i.e., below 32° F., to above 120° F. The characteristics for the tabs must be as above-described over this full temperature range.

Returning to FIG. 1, the liquid material to be dispensed from nozzles 26 is dispensed at a temperature of about 350–450° F., preferably at about 425° F., and at a pressure of between 1300–1500 psi. Each orifice opening is about 0.026 inches in diameter. The saturated felt material underneath the nozzles may have only dropped to about 315° F. from the temperature of about 400° F. of treatment area 14 at the time the material is deposited thereon from nozzles 26. The tabs that are formed are identified by numerals 29*a*, 29*b*, . . . 29*x*. The on/off timing of nozzle 26 and the rate of movement of the saturated felt material, i.e., line speed, is programmably matched by microprocessor 30, as described more fully below. Generally, however, microprocessor 30 controls the "on" time and "off" time of applicator nozzles or nozzle sets 26 so that the dimensions and spacing of the tabs are correct. The operation of microprocessor 30 is coordinated in operation with microprocessor 29 monitoring the line speed.

As the saturated felt with tabs attached leaves line area 18, it passes by grooved wheel 32. The grooves in grooved wheel 32 permit the tabs to pass through without being subject to possible scraping action. From wheel 32, the felt enters into "free looper" 34 and from there to make up roller area 36. Roller area 36 is where the final rolls are produced. Typically, #30 weight saturated felt material is cut and rolled in 70-foot lengths and #15 weight material is cut and rolled in 140-foot lengths. The line speed preferably moves at between 300–800 ft. per minute. Thus, every 6 to 12 seconds for a felt material movement of 700 ft. per minute, the material is cut, a roll is finished and a new roll is started.

Figure 2:
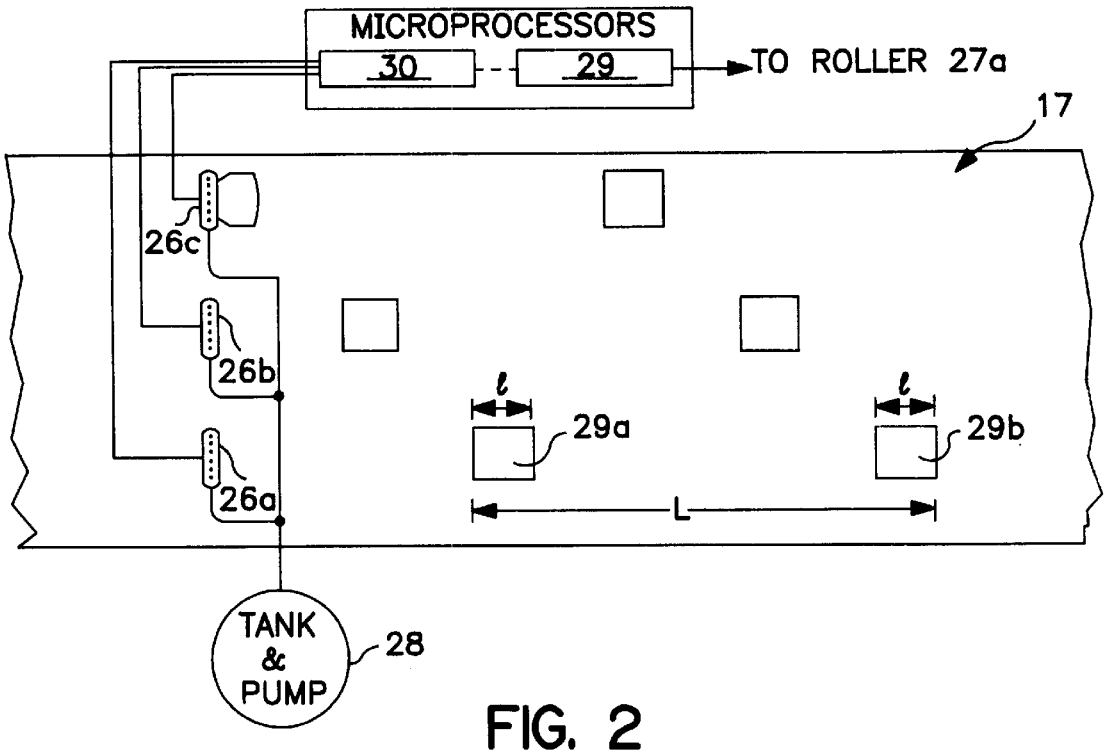
FIG. 2 is a schematic top view of the nail tab production area of the automated process shown in FIG. 1.

Now referring to FIG. 2, a top view of saturated felt material 17 is shown in line area 18. Three nozzles 26*a*, 26*b*, and 26*c* are shown for forming three linear rows of tabs parallel with the elongate dimension of material 17. A sheet of saturated felt material is typically 3-feet wide. In actual practice, there can be more than three rows. The tab size is exaggerated for illustration purposes, but, typically, one row of tabs is produced near the front edge of material 17, another row of tabs is produced near the back edge, and a third row of tabs is produced mid-way between these edge rows. The front row of tabs, including tabs 29*a* and 29*b*, is produced from the liquid material dispensed from first nozzle 26*a*.

One preferred embodiment of a suitable nozzle is a manifold housing being opened in the form of a plurality of individual, but closely spaced orifices. Five or six such orifices have been successfully employed. These orifices are shown in line transverse to the direction of movement of felt material 17; however, they can be in some other pattern, if desired. The number of these openings generally determines the width of a produced tab. Each of nozzles 26*a*, 26*b*, and 26*c* is connected to pressurized tank and pump 28 and controlled in on/off operation by microprocessor 30, which, in turn, is closely coordinated in operation with line-speed monitoring microprocessor 29. It will be seen that it is preferred that the production of tabs produces a staggered arrangement of the tabs across or transverse to the moving direction of felt 17.

Preferably, the tabs are square, but they may be rectangular or other shape. In FIG. 2, the length of a tab is defined as "l". If the time of application or "on" time for a nozzle is defined as "t" and the line speed of the material is defined as "S", then the formula $$t = \frac{l}{S}$$

applies where t, l and S are expressed in consistent units.

To calculate, for convenience, how long it would take to form a 1-inch long tab for a line speed of 600 ft. per minute, the answer would be about 0.0083 seconds. The preferred operation coordinates the operation of the nozzles to the line speed via microprocessor 30 so that as the line speed may vary, the tab lengths will remain substantially uniform. Separately controlled line speed and nozzle operation can be performed, however, if desired. Alternately, a single microprocessor combining the operations of microprocessors 29 and 30 can be employed.

The spacing of the tabs is determined by the "off" time of the nozzles. For convenience of calculation, the distance from the leading edge of tab 29*a* to the leading edge of tab

29*b* is defined as "L". The time between tabs is defined as "T". Therefore, the following equation applies for calculating the distance L:

$$T = \frac{L}{S}.$$

The preferred width and length dimensions of tabs are between 0.75–1.5 inches. The thickness of a tab is typically about 0.04 inches. The spacing distance of the tabs is normally 1 to 3 feet.

Figure 3:
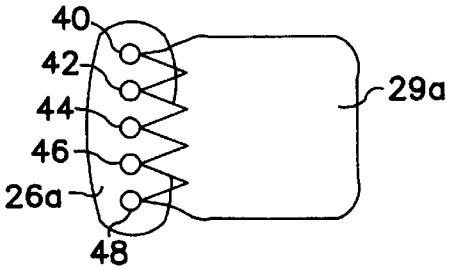
FIG. 3 is a schematic representation of a nozzle with a manifold housing having a plurality of orifices used in the process of manufacturing the composite roofing material as shown in FIG. 2.

FIG. 3 shows a close up view of tab 29*a* being formed in the dispensing of material from a nozzle 26*a* having five in-line orifices 40, 42, 44, 46 and 48. As the material flows out of the orifices in a liquid state, the width of the tab becomes slightly larger than the distance between the outermost orifices before it begins to harden. Also, note that the liquid from each of the orifices runs together with adjacent deposits so that the formed tab has a uniform thickness dimension when it hardens. Fewer or a greater number of orifices can be employed, if desired.

Figure 4:
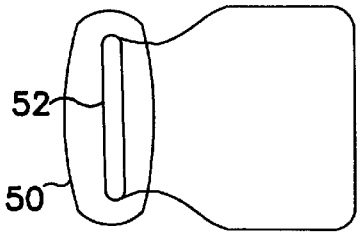
FIG. 4 is a schematic representation of a nozzle having an elongated slit used in the process of manufacturing the composite roofing material as shown in FIG. 2.

FIG. 4 illustrates an alternate nozzle structure wherein nozzle 50 has a single elongate slit 52 that is positioned transverse to the movement of felt material 17.

Although the above description has been with regard to providing tar paper or saturated felt material with integrally formed nail tabs, other covering sheets or boards of building material can be similarly treated. For example, cover sheets of siding materials employed before installing the final or finished siding can employ suitable rows of nail tabs spaced compatibly with the spacing of studs. Stud spacing is standard in a locale as determined by local building codes, but studs are typically spaced apart either 16 inches or 24 inches. Therefore, nail rows of the appropriate predetermined standard interval spacing can be provided so that when the siding is put in place, the nail rows will be centered on the studs. An installer can then secure the siding in place quickly with a nail gun targeting the tabs, which will also target the studs.

Although the siding may be in sheet form, it can also be in board form. Typical styrofoam board sheathing is 4 feet by 8 feet by 1 inch. Again, nail tabs as hereinabove described can be provided appropriately spaced to center on the studs. When the boards are thus positioned, then targeting the nail tabs by an installer using a nail gun will also target the studs. Boards can be made with integrally formed nail tabs by appropriately positioning the nozzles to formed rows at appropriate intervals and then feeding the boards through area 18 of FIG. 1 in a manner similar to feeding rolled sheet material in the process previously described.

Therefore, while a particular embodiment of the invention has been shown, it will be understood that the invention is not limited thereto. Many modifications may be made and will become apparent to those skilled in the art. For example, if nail tabs are to be made on the reverse side of the roofing material as well as on the top side, the material with nail tabs on a first side is merely run through a second set of nozzles after first being passed over a reversing roll.

What is claimed is:

1. A roofing material of the type generally applied to roofs prior to the application of roofing shingles, comprising saturated underlayment material, and a plurality of nail tabs made of a thermoplastic or thermosetting material formed at spaced intervals by depositing said tabs onto the surface of said saturated underlayment material in a liquid state, which subsequently solidifies and bonds to said saturated underlayment material.

2. A roofing material in accordance with claim 1, wherein said thermoplastic or thermosetting material includes reinforcing particles.

3. A roofing material in accordance with claim 2, wherein said reinforcing particles are glass fibers.

4. A roofing material in accordance with claim 1, wherein said saturated underlayment material is asphalt saturated felt material.

5. A roofing material in accordance with claim 1, wherein said tabs are made of a thermoplastic material that is primarily low density polyethylene.

6. A roofing material in accordance with claim 5, wherein said thermoplastic material includes a dye of contrasting color with said saturated underlayment material.

7. A roofing material in accordance with claim 1, wherein said tabs are made of a thermosetting material.

8. A building cover material of the type generally applied prior to the application of a finishing covering, comprising a flat sheet or board covering material for covering studs spaced at predetermined regular intervals, and a plurality of nail tabs made of a thermoplastic or thermosetting material formed at spaced intervals by depositing said tabs onto the surface of said covering material in a liquid state, which subsequently solidifies and bonds to said covering material.

* * * * *